United States Patent [19]

Prescott

[11] 3,990,368

[45] Nov. 9, 1976

[54] ACTUATOR ASSEMBLY FOR MUNITION FUZE

[75] Inventor: Paul E. Prescott, Excelsior, Minn.

[73] Assignee: The United States of America as represented by the Secretary of the Army, Washington, D.C.

[22] Filed: May 1, 1972

[21] Appl. No.: 249,456

[52] U.S. Cl. ..... 102/73 R; 102/76 R

[51] Int. Cl.[2] ..... F42C 1/00

[58] Field of Search ..... 102/70, 73, 76, 78, 102/8, 16; 42/1 R

[56] References Cited

UNITED STATES PATENTS

| | | | |
|---|---|---|---|
| 2,378,626 | 6/1945 | Fanger | 102/76 R |
| 2,941,472 | 6/1960 | Lee et al. | 102/8 X |
| 3,106,893 | 10/1963 | Brandt | 102/78 |
| 3,158,705 | 11/1964 | Bliss | 102/73 R |

*Primary Examiner*—Harold Tudor

*Attorney, Agent, or Firm*—Nathan Edelberg; A. Victor Erkkila; Max Yarmovsky

[57] ABSTRACT

A projectile actuator assembly for detonating a munition upon impact on soft snow. The actuator comprises a housing which has a longitudinal bore communicating with a threaded end and a partially closed flanged end, a biased top spring operatively screwed to the threaded end, a biased stop spring pinned to the flange end, a collapsible column means axially positioned in said housing bore intermediate to the top spring and the stop spring, and a firing means, for actuating the munition when the column means collapses upon impact.

4 Claims, 3 Drawing Figures

ACTUATOR ASSEMBLY FOR MUNITION FUZE

The invention described herein may be manufactured, used and licensed by or for the Government for governmental purposes without the payment to me of any royalty thereon.

BACKGROUND OF THE INVENTION

The maximum lethality of the 40 mm anti-personnel cartridge, having a round which includes a fragmenting sphere, depends upon its sensitivity to impact. In those applications where the impacting area for the round will be on a relatively hard surface as earth, stone, concrete, a vehicle, no significant problems have occurred with prior art devices, they have functioned well producing an air burst of the fragmenting sphere or envelope with uniform dispersal of the lethal fragments. Problems have arisen in the use of these anti-personnel munitions where the striking surface is likely to be soft snow. Prior art devices which have their impact actuation mechanisms designed to be sensitive to soft snow impact or graze impact have been found to be also sensitive to activation by rain drops. Such prior art devices which are activated by coming in contact with rain are unsatisfactory because they endanger the launching personnel. Those prior art impact devices which are insensitive to rain and wind generally will also be insensitive to snow impact. Where the snow is deep this insensitivity results in the round burying itself below the surface before explosion with a consequent loss in effectiveness.

The present device is an actuator assembly which provides an operational capability for 40 mm cartridges, having anti-personnel rounds, capable of functioning when impacting on a surface of soft snow. The present actuator assembly device is particularly useful for medium round ammunition such as the 40 mm cartridge because it can be made small in size, and is relatively inexpensive because of its simple and rugged construction.

SUMMARY OF THE INVENTION

The present invention is an actuator assembly which provides an operation capability for 40 mm cartridges fixed to impact on the surface of soft target media such as snown. The actuator construction is such that it will become armed and capable of performing its function only after the carrier to which it is attached has received a set-back force equivalent to what a round of 40 mm cartridge will experience. In the present invention a collapsible two part column member is biasedly held in a housing. Under normal pre-fired conditions, the two part column is held between a top adapter spring and a stop spring. Both springs are biased toward the center of the assembly so that a constant pressure is exerted against the ends of the two part column. In the pre-fired state, collapse of the two column member is prevented by a lock sleeve and ball locking means. In the safe position a firing actuator spring is held in biased position by the stop spring. In operation, after the projectile has received a set-back force, the sleeve and ball locking means unlock permitting collapse of the column upon impact on snow. The collapse of the column permits the stop spring to move toward the center of the assembly releasing an oppositely biased actuator spring to move away from the center of the actuator, which then snaps against a firing member causing it to impinge against a detonator thereby causing detonation of the munition. The top spring and spring adapter assembly are adjusted so that a force of approximately 5 pounds at the center of the stop spring will deflect the top spring at its center for a distance of 5/1000 of an inch. When the munition is fired, the resulting setback forces drive the lock sleeve forwardly to the (right in FIG. 1) to compress a creep spring. This forward movement and the centrifugal forces of the spinning round will cause the locking ball to be released and to move away from the actuator's longitudinal axis and from its locking position. When the setback force is removed, the lock sleeve is driven backwardly by the creep spring so that it no longer rigidly supports the two part column member. During missile flight, with no other forces than aforementioned acting on the column and the compressive forces of the top spring and the stop spring, there is no tendency for the column to collapse. However, upon impact in any orientation, the resulting inertial forces will upset the column balance and cause the two piece column to collapse. The collapse of the two part column will result in the activation of the firing member and the detonation of the missile warhead as aforedescribed.

One of the objects of this invention is to provide an actuator assembly for a 40 mm cartridge having a capability to impact on soft snow.

Another object of this invention is to provide an actuator assembly which will insure the safety of the launch operator of a 40 mm cartridge so that it will not become armed until it has received a set-back force caused by the firing of the propellant charge of the cartridge.

Another object of this invention is to provide an operational capability for a 40 mm cartridge which will impact on soft snow, or to a graze impact from any direction on other surfaces, and not be actuated upon impact with rain and/or wind.

Another object of this invention is to provide an actuator assembly for a 40 mm cartridge having an anti-personnel round which is inexpensive to manufacture, and reliable in operation because of its simplicity in construction and ruggedness of parts.

While certain objects, features and advantages of the present invention have been specifically pointed out, others will become apparent from the following description taken in connection with the accompanying drawings.

BRIEF DESCRIPTION OF THE DRAWINGS

Throughout the following description like reference numerals are used to denote like parts of the drawing.

DESCRIPTION OF THE PREFERRED EMBODIMENTS

Figure 2:
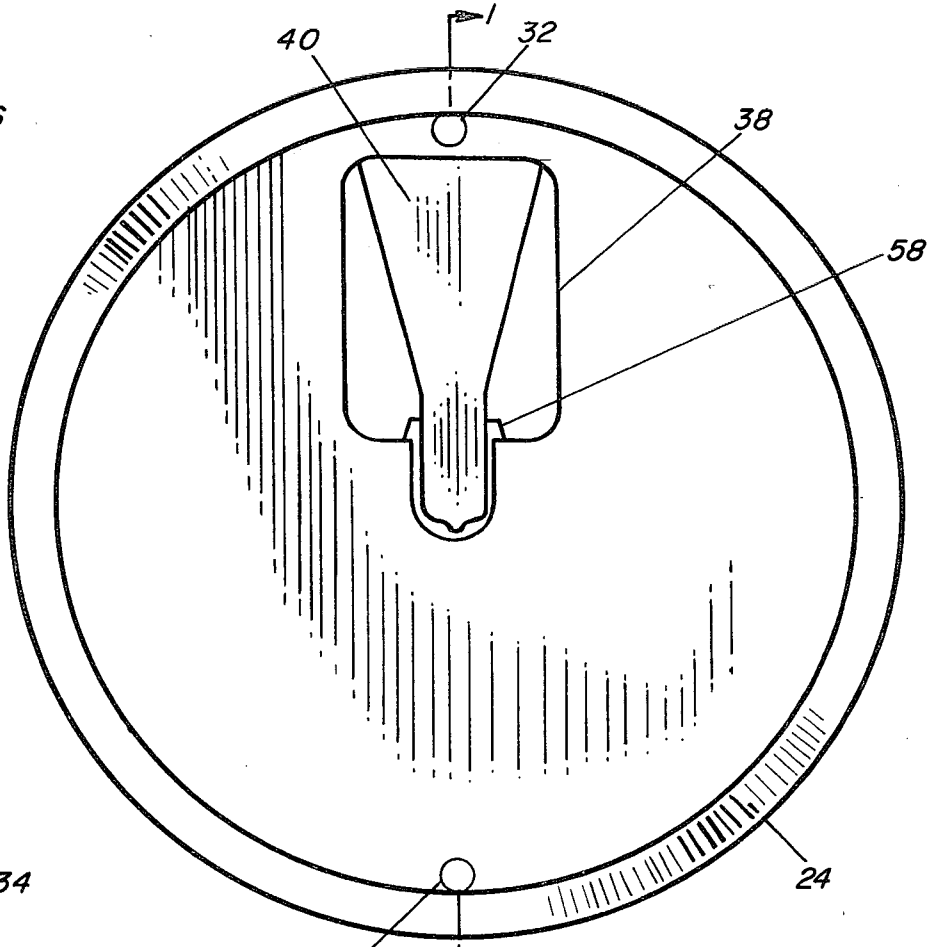
FIG. 2 is a left hand elevational view of FIG. 1.
Figure 1:
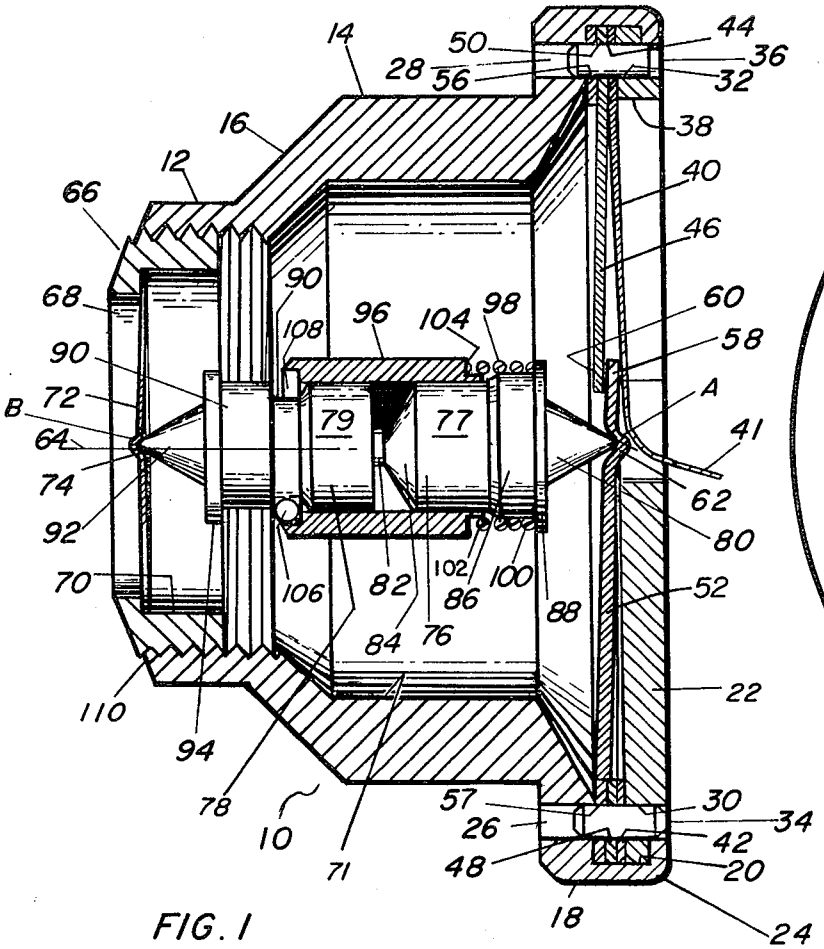
FIG. 1 is a partial cross-sectional view of the actuator assembly in the safe position as illustrated in FIG. 2 taken along line 1—1.

Referring now to FIGS. 1 and 2, the actuator assembly is shown in its operative safe position with elements of the actuator assembly located with reference to each other prior to experiencing the setback forces. The housing 10 has a first hollow cylindrical internally threaded end 12 which is connected to a second larger diameter hollow cylindrical section 14 by a modified hollow frusto conical section 16. The second cylindrical section 14 of the housing has an integrally appended circular flange 18, of slightly larger diameter than the second housing cylindrical section 14, located on the other end of housing 10. The flange 18 has a plate support counter bore 20 which slidably engages a circular shaped plate support section 22 and is held thereto by stake 24. Flange end 18 has two locating holes 26 and 28 peripherally positioned and diametrically opposed on the same radius and of the same hole diameter as the two plate support locating holes 30 and 32. Two spiral pins 34 and 36 locate the support plate section 22 and its firing member plate support clearance slot 38 with respect to firing member 40. Firing member 40, biased spring actuator 46, and stop spring 52 each have two locating holes 42, 44, 48, 50, 56 and 57 respectively of the same diameter and diametrically spaced as the aforementioned flange and plate support locating holes 26, 28, and 30, 32. Spiral pins 34 and 36 slidably also engage the aforementioned locating holes of the spring actuator 46 and the stop spring 52 so that the stop spring end 58 is biasedly positioned intermediate to the striking end 41 of the firing member 40 on one side and the actuator spring lever end 60 on the other side. The actuator spring lever end 60 and the firing member 40 are held is a biased position away from each other by the stop spring end 58. Stop spring 52 has a stop spring spherically shaped indentation 62 whose center line is axially aligned with the longitudinal axis 64 of the housing 10. An externally threaded spring adapter 66 engages the internal threads of the first cylindrical housing section 12. The spring adapter 66 has a central bore 68 and an axially aligned second top spring holding bore 70 of slightly larger diameter than the central bore 68 for holding therein a biased disc shaped top spring 72. A main housing bore 71 is axially aligned with the longitudinal axis of the spring adapter 66 and the flange end 18 of the housing 10. Top spring 72 has a spherically shaped indentation 74 whose center line is axial with the center line 64 of the housing 10. Biasedly positioned between the top spring indentation 74 and the stop spring indentation 62 is a two part column support consisting of a lower column support cylinder 76 axially aligned with and immediately adjacent to an upper support column 78. The lower support column 76 has an axial cone 80 on one end and a small right cylinder 82 shape on the other end. Intermediate to the main portion 77 of lower support column cylinder 76 and the small cylinder 82 is a frusto conical surface 84. A creep spring guide cylinder 86 of slightly larger diameter than the main portion 77 of lower support column 76 is intermediate thereto and a creep spring retaining flange 88. All of the aforementioned sections of the lower support column 76 are axially aligned with respect to each other and with respect to the actuator assembly longitudinal axis 64. The main portion 79 of upper support column 78 is of the same diameter as the main portion 77 of lower support column 76 and has a ball retaining groove 90 circumferentially located therein. The upper end of the upper support column 78 has an axial cone 92 which abuts against the top spring spherical indentation 74. Intermediate to the groove 90 and the upper support axial cone 92 is a sleeve lock stop flange 94 which is larger in diameter than the main portion 79 of upper support column cylinder 78. A cylindrical lock sleeve 96 slidably engages and retains the upper column support 78 and the lower column support 76 in axial alignment with the actuator assembly center line 64. In the safe, unfired position biased helical creep spring 98 slidably fits over the creep spring guide cylinder 86 and has a first end 100 adjacent to the creep spring retaining flange 88 and the other end 102 of the creep spring held in a lock sleeve spring retaining groove 104. The lock sleeve 96 is held in the aforementioned safe position by the biased creep spring 98 on one end and on the other end by a ball 106 which is retained in the ball retaining groove 90 and the lock sleeve ball counter bore 108. The spring adapter 66 is threaded into the actuator housing threaded end 12 and staked by housing stake 110 so that a force of 5 pounds at point designated A on the stop spring end 58 deflects the top spring 72, measured at point B, by approximately 5/1000 of an inch.

Figure 3:
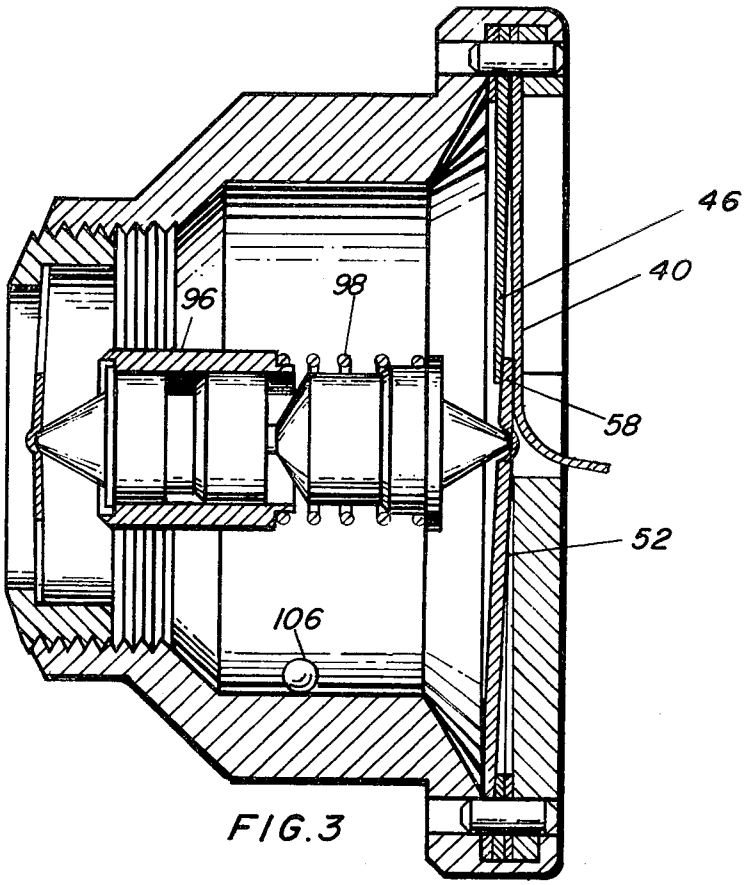
FIG. 3 is a partial cross-sectional view of the actuator assembly in the armed position.

Referring now to FIG. 3, the actuator assembly is shown in the armed position. When the munition is fired, the resulting setback forces drive the lock sleeve 96 toward the firing pin end member to compress the creep spring 98. This motion of the lock sleeve 96 releases the locking ball 106 from the lock sleeve ball counter bore 108. When the initial setback force is removed, the lock sleeve 96 is driven toward the impact end by the creep spring 98 as shown in FIG. 3 so that the former no longer supports the two column members 76 and 78 respectively. At this point in time, with no force acting on the two member column except the top spring 72 and the stop spring 52, there is no tendency for the column to collapse. Upon impact in any orientation, the resulting inertial forces cause the two pieces to collapse. The stop spring lever end 58 is then released and is moved rapidly toward the center of the assembly thereby releasing the biased actuator spring 46 which then on return snaps against the firing member 40 to cause detonation of the attached munition (not shown).

I wish it to be understood that I do not desire to be limited to the exact method and detail of construction described for obvious modification will occur to persons skilled in the art.

What is claimed is:

1. A projectile actuator for detonating a munition upon impact on soft snow comprising:

a housing having a longitudinal bore communicating with a first end and a partially closed flange end;

a plate support section fixedly positioned in said flange end;

a biased top spring affixed to said first end;

a pair of spiral pins positioned in the flange end of said housing for locating said support plate therein;

a biased stop spring lever having one end fixedly pinned to said flange end by one of said pair of spiral pins;

collapsible column means for holding said stop spring lever and said top spring in a biased condition when said projectile is in a safe position; and firing means for actuating the detonation of said munition when said column means collapses upon impact of said projectile on a target.

2. A projectile actuator as recited in claim 1 wherein said collapsible column means comprises:

a lower support column having an axially oriented support cone on one end held in said stop spring and a small axial cylinder on the other end, an upper support column having an axial upper cylindrical end immediately adjacent to said lower support end cylinder, an upper support axial cone held in said top spring and a ball retaining groove intermediate said upper cylindrical end and said upper cone; and locking means for circumferentially holding said lower support column and said upper support column intact and intermediate to said biased top spring and said biased stop spring when said munition is in a safe position, and for releasing said supports so that they can collapse upon impact after said projectile actuator assembly has experienced setback forces.

3. A projectile actuator assembly as recited in claim wherein said locking means comprises:

a biased helical creep spring;

a lock sleeve slidably fitting over said lower support column and said upper support column cylindrical end having a lock sleeve spring retaining groove on one end fitting into one end of said creep spring and a ball counter bore on the other end; and a ball held in said lock sleeve counter bore intermediate to said upper support ball retaining groove for positioning said lock sleeve circumferentially about said upper and lower support columns, locking said columns together when said munition is in an unfired condition, and causing said lock sleeve upon receipt of setback forces to first move toward said lower support column, compressing said creep spring, releasing said ball from said lock sleeve ball retaining groove, and upon depletion of the setback force permitting said biased creep spring to drive said lock sleeve away from said lower support column thereby allowing said lower and upper columns to collapse when the projectile impacts.

4. A projectile actuator assembly as recited in claim 3 wherein said firing pin means comprises:

a firing pin having a fixed pinned end and a movable striking end; and a biased cantilever actuator spring having a pinned fixed end adjacent to said firing pin fixed end, a movable actuator spring lever biased away from said striking end by said stop spring so that when said lower and upper support columns collapse upon impact with soft snow said stop spring lever will move toward the center of said housing, thereby releasing said actuator spring lever to snap against said firing pin causing detonation of said munition.

* * * * *